United States Patent [19]

Reed

[11] Patent Number: 4,479,537

[45] Date of Patent: Oct. 30, 1984

[54] POWER TUBING HANGER AND TUBING STRING LIFTING ASSEMBLY

[75] Inventor: Lehman T. Reed, Bakersfield, Calif.

[73] Assignee: Midway Fishing Tool Co., Long Beach, Calif.

[21] Appl. No.: 535,684

[22] Filed: Sep. 26, 1983

[51] Int. Cl.[3] ..... E21B 19/00

[52] U.S. Cl. ..... 166/77; 166/85

[58] Field of Search ..... 166/77, 77.5, 85, 381; 254/29 R, 30

[56] References Cited

U.S. PATENT DOCUMENTS

| | | | |
|---|---|---|---|
| 3,282,357 | 11/1966 | Bunn | 254/30 |
| 3,404,741 | 10/1968 | Gheorghe et al. | 166/77.5 |
| 4,251,176 | 2/1981 | Sizer et al. | 166/77 X |

*Primary Examiner*—Stephen J. Novosad
*Assistant Examiner*—Thuy M. Bui
*Attorney, Agent, or Firm*—William C. Babcock

[57] ABSTRACT

A hydraulically operated assembly that may be removably secured to the well head of an oil well to concurrently raise a tubing hanger that has a tubing string supported in either a centered or offset position therefrom to an elevation where replacements or repairs may be made to electrical components including the lower electrical connector. The tubing string upon being lifted is moved to a centered position in the blow out preventer to permit the latter to be closed to gain control of the well if necessary. The assembly eliminates the necessity of moving a rig over the well to service the electrical components therein.

9 Claims, 15 Drawing Figures

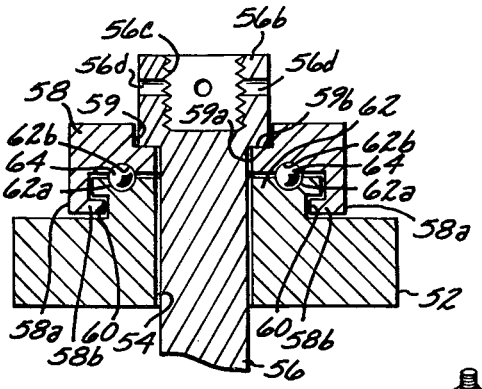
FIG.4
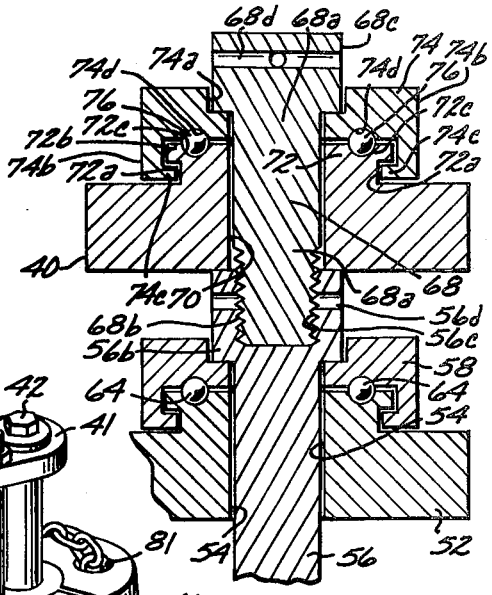
FIG.5
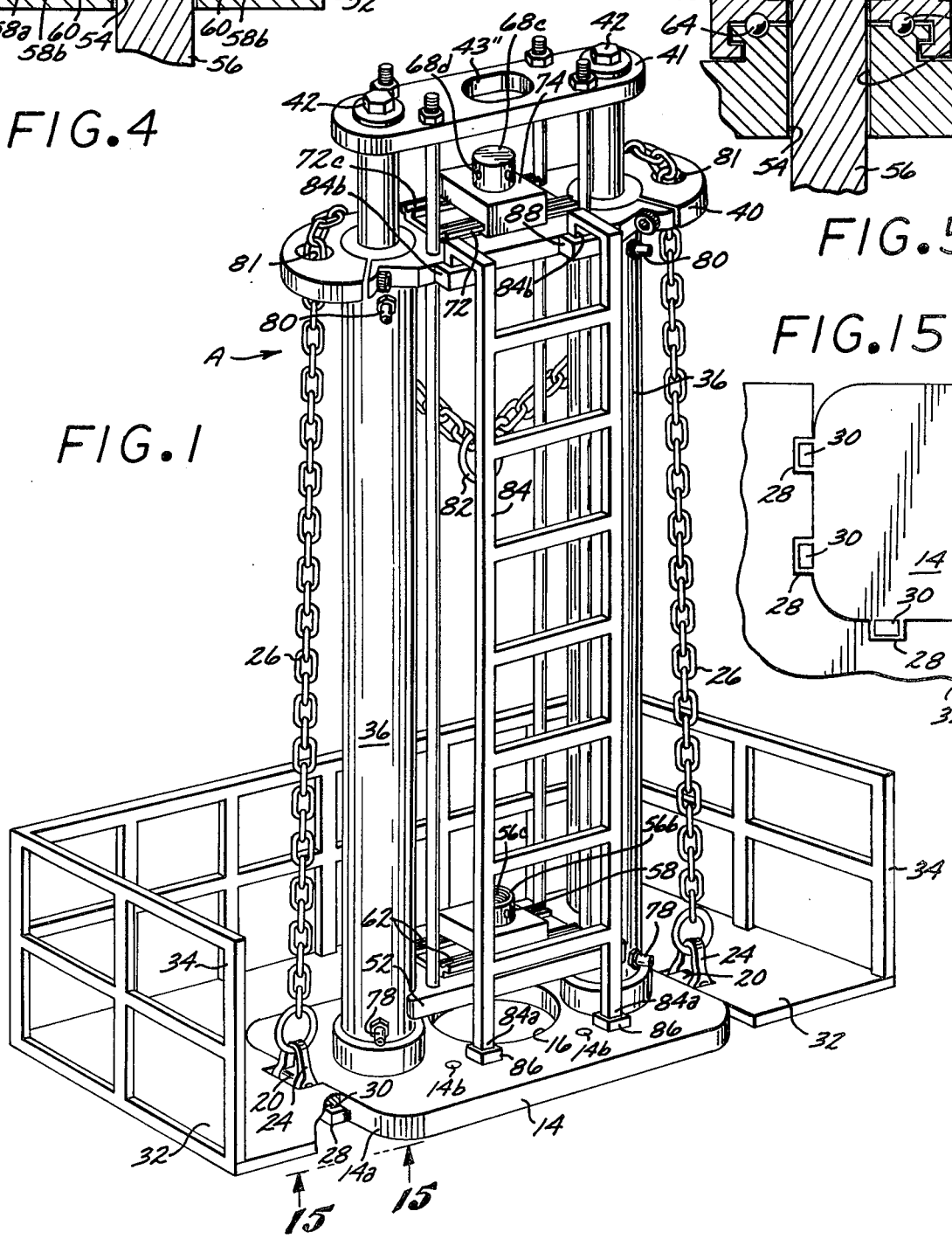
FIG.1
FIG.15
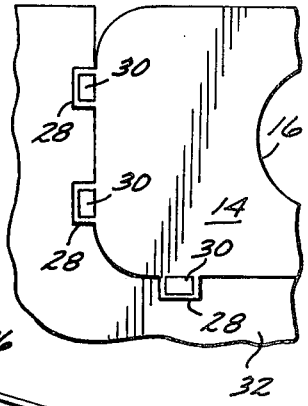

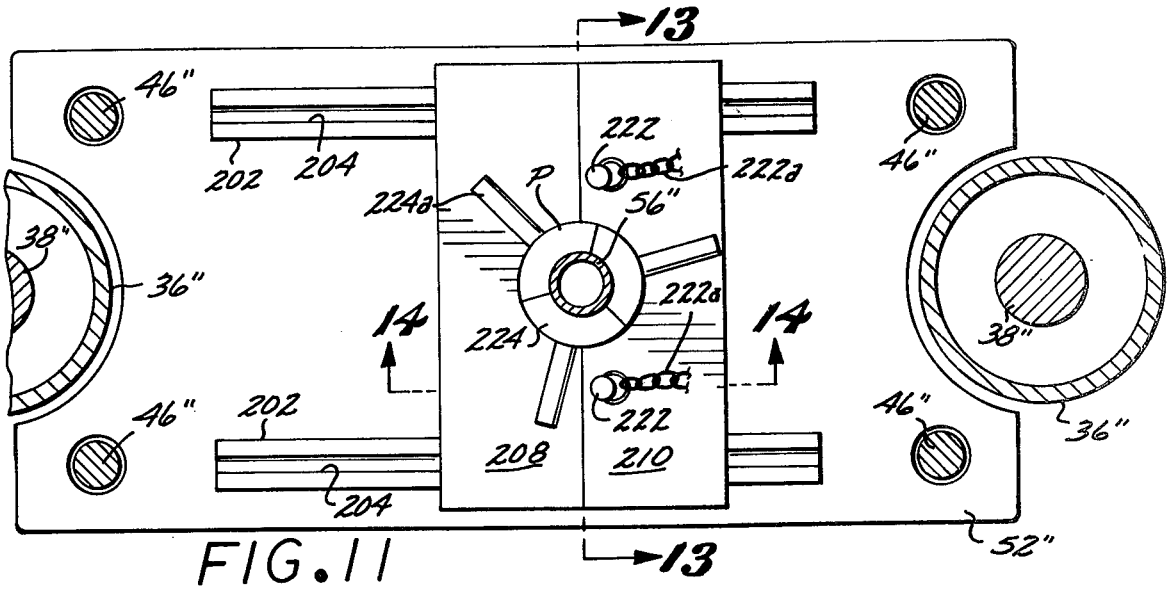
FIG. 11
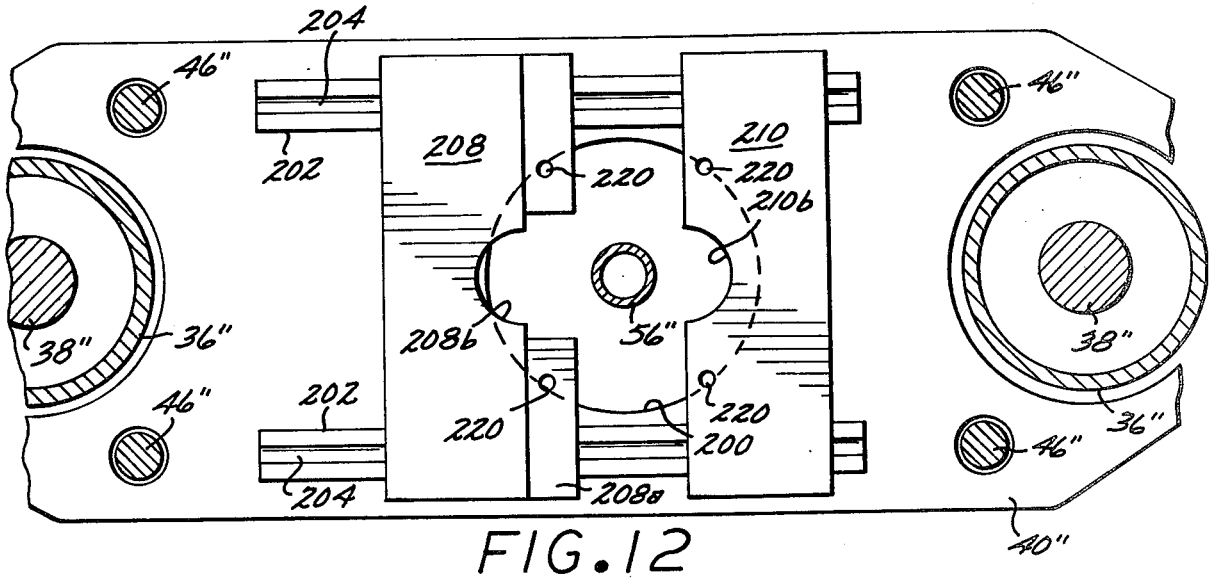
FIG. 12
FIG. 13
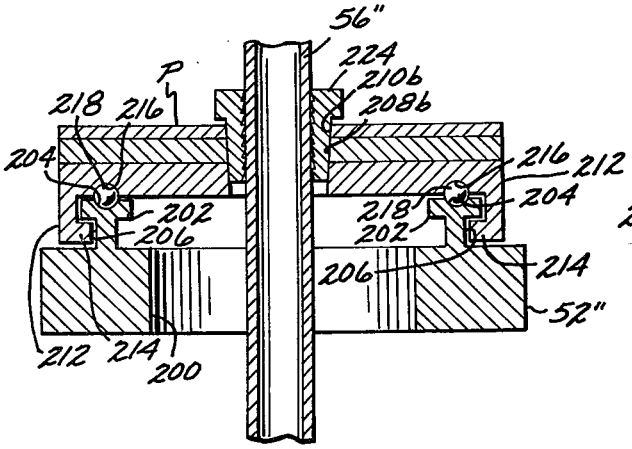
FIG. 14
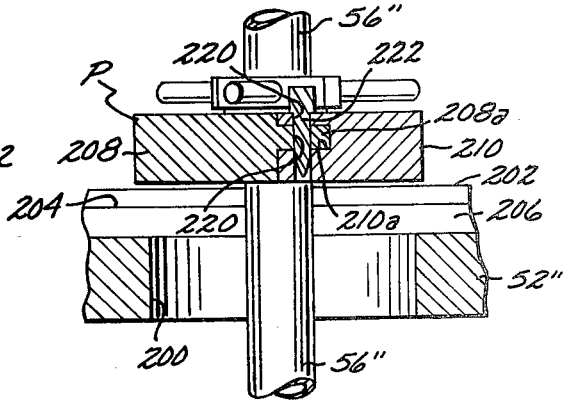

POWER TUBING HANGER AND TUBING STRING LIFTING ASSEMBLY

BACKGROUND OF THE INVENTION

A typical submerged oil well includes an electric motor driven down hole pump located at the lower end of a tubing string, with the upper end of the latter suspended from a tubing hanger removably supported in a well head. A Christmas tree array of valves is removably supported on the well head or a spool mounted on the latter.

A commonly used form of tubing hanger has an electrical conductor extending longitudinally therethrough, with the conductor on the upper and lower ends having connectors removably secured thereto that extend to a source of electric power and downwardly in the bore hole of the well to a submersible electric motor that drives a down hole pump. Due to the electrical conductor, the tubing string is supported from the tubing hanger in an off centered position thereon.

Periodically it is necessary to replace the connectors on the tubing hanger. Such replacement must be carried out under conditions where the oil well is at all times maintained under control.

A major object of the present invention is to provide a portable power operated assembly that may be removably secured in a fixed position relative to a well head to raise a tubing hanger and tubing string to permit electrical connectors and components to be replaced that are used in supplying electric power to an electric motor driven down hole pump, and without setting a tubing string pulling rig over the well.

Another object of the invention is to provide an assembly that may be removably secured to a blow out preventer secured to the well head, with the tubing hanger and portion of the tubing string being moved upwardly through the blow out preventer with the tubing string off centered relative thereto, and the tubing hanger being shifted laterally after the latter is above the blow out preventer to center the tubing string in the latter to permit the blow out preventer to be closed if necessary to maintain control of the well, and the tubing string being returned to an offset position in the well by reversing the above procedure.

SUMMARY OF THE INVENTION

The present invention is a portable hydraulically operated assembly that may be used to concurrently raise a tubing hanger and a tubing string, and electric motor powered downhole pump secured to the latter to an elevated position relative to an oil well to permit replacement of electrical connectors on both the tubing hanger and pump motor. The tubing hanger supports the tubing string in a laterally offset position.

The oil well includes a well head in which the tubing hanger is removably supported. The well head has an array of valves removably secured thereto and extending upwardly therefrom. The tubing hanger has a vertically extending passage therein, the upper portion of which is threaded, with the flow of fluid upwardly through the passage being controlled by the previously mentioned valves. Prior to using the assembly, a plug is removably inserted in the tubing string below the tubing hanger by a procedure in common use in present day oil field practice.

The array of valves after the tubing string has been plugged is removed from the well head and replaced by a blow out preventor, which blow out preventor when in an open position permits the tubing hanger to be moved upwardly therethrough. The blow out preventor has a flat, upper, ring shaped surface from which a number of spaced stud bolts extend upwardly.

A first form of the hydraulically operated assembly includes a base having a centered opening of greater diameter than that of the tubing hanger. The base has a number of spaced transverse bores therein through which the stud bolts may extend to removably secure the base to the blow out preventor. A pair of hydraulic cylinders are secured to the base on opposite sides of the centered opening therein, with the upper ends of the cylinders being connected by a cross piece. The upper ends of the piston rods that are slidably movable in the hydraulic cylinders are connected by a transverse lifting member, which member has a pair of parallel laterally spaced rods extending downwardly therefrom through openings in the cross piece to support a horizontal pull plate on the lower ends thereof.

The pull plate has a first longitudinally movable carriage mounted thereon that rotatably supports a pulling sub having a lower threaded end that can engage the threaded upper end of the passage in the tubing hanger. The cross piece supports a second longitudinally movable carriage that rotatably supports a safety sub that has a lower threaded end that may removably engage a tapped recess in the upper portion of the pulling sub, when the pull plate is adjacently disposed to the cross piece.

After the hydraulic cylinders have been actuated to move the pulling plate pulling sub, and the tubing hanger upwardly until the latter is above the blow out preventor, the first carriage is moved horizontally to dispose the tubing string in a centered position within the blow out preventor to permit the latter to be closed if necessary to maintain control of the oil well. Upward movement of the pulling sub and tubing hanger is continued until the pulling sub can be removably connected to the safety sub to permit inadvertant downward movement of the tubing string. The tubing hanger is now in a position to permit repairs to be made to the electrical connectors supported therefrom. After the repairs have been completed the tubing string and tubing hanger are returned to their initial position by reversing the above described steps. The hydraulically operated assembly is separated from the blow out preventor. The blow out preventor is then separated from the well head and replaced by the array of valves. The plug is removed from the tubing string to return the well to an operating condition.

A second form of the hydraulically operated assembly performs the same functions as previously described, but with the lateral shifting of the tubing string relative to the blow out preventer being achieved by the hydraulic cylinders being movably supported on the base of the invention.

A third form of the invention operates in the same manner as the first form, but with the first and second carriages having slips mounted thereon, to permit the tubing string to be raised and successively gripped in steps until the electric motor that powers the downhole pump is situated above the base of the assembly to permit replacement of the electrical connectors thereon.

In all three forms of the invention the tubing hanger, tubing string and the electric motor that powers the downhole pump are returned to their original position by reversing the steps above described. The hydraulically operated assembly is moved from well to well in an oil field as required by a suitable power operated vehicle. After the repairs have been made to the connectors, the hydraulically operated assembly is disengaged from the stud bolts on the blow out preventer, with the blow out preventer then being disconnected from the well head and replaced by the array of valves. The plug is then removed from the tubing string to permit flow of fluid from the tubing string to the christmas tree assembly.

BRIEF DESCRIPTION OF THE DRAWINGS

FIG. 1 is a perspective view of a first form of hydraulically operated apparatus that may be removably secured to the blow out preventer of an oil well that has an electrically operated downhole pump to concurrently raise a tubing hanger and a tubing string supported in off centered position therefrom to an elevation where defective electrical components may be replaced while maintaining the tubing string in a centered position in the blow out preventer to permit the latter to be closed if necessary to maintain control of the well;

FIG. 4 is a fragmentary vertical cross sectional view of the apparatus taken on the line 4—4 of FIG. 2;

FIG. 5 is a fragmentary vertical cross sectional view of the apparatus taken on the line 5—5 of FIG. 3;

FIG. 11 is a combined top plan view and horizontal cross sectional view of the invention shown in FIG. 10 taken on the line 11—11 thereof;

FIG. 12 is a fragmentary top plan view of the invention shown in FIG. 10 taken on the line 12—12 thereof;

FIGS. 13 and 14 are fragmentary vertical cross sectional view of the third form of the invention taken on the line 13—13 and 14—14 of FIG. 11; and FIG. 15 is a fragmentary plan view of the first form of the invention taken on the line 15—15 of FIG. 1.

DESCRIPTION OF THE PREFERRED EMBODIMENT

A first form of a portable hydraulically operated tubing hanger lifting assembly A for use on an oil well as shown in FIG. 1. The assembly A is illustrated as removably mounted on a blow out preventer B that is secured to a utilized well head C of an oil well by a clamp D. The blow out preventer B has replaced an array of valves (not shown) that was secured to the well head C of an oil well when the latter is in an oil producing condition.

Figure 2:
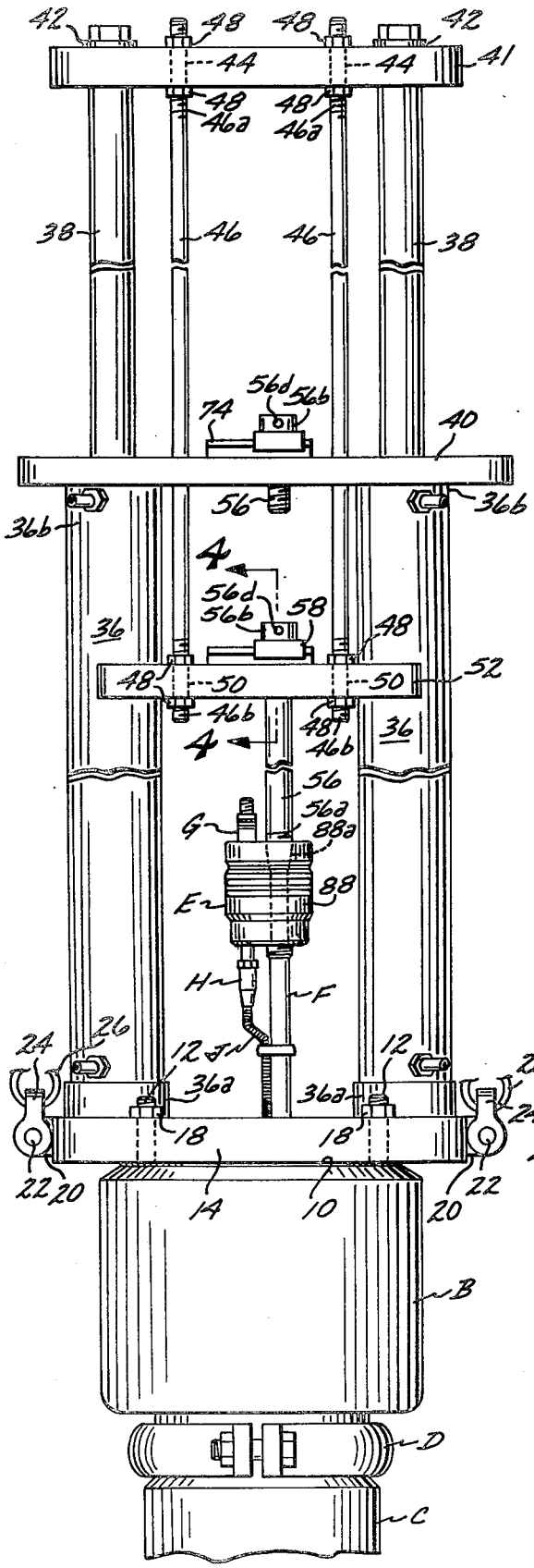
FIG. 2 is a side elevational view of the apparatus illustrated in FIG. 1 with a tubing hanger and tubing string supported therefrom in an off centered position being raised from a well, and the tubing hanger and tubing string having been moved laterally where the tubing string is centered in the blow out preventer to permit the latter to be closed to maintain control of the well.

When the oil well of which the well head C is a part is in an oil producing condition, a tubing hanger E of the structure shown in FIG. 2 is removably supported in the well head C and has an off centered tubing string F depending therefrom into the well.

The tubing hanger E as shown in FIG. 2 has an off centered electrical conductor G extending longitudinally therethrough. The lower end of the electrical conductor G has a connector H removably secured thereto, which connector has an electrical conducting cable J extending down in the bore hole of the oil well to an electric motor (not shown) that drives a downhole pump (not shown). The upper end of the electrical conductor G may be removably engaged by a connector H that is connected to an electrical conducting cable (not shown) that extends to a source of electric power (not shown).

The assembly A as best seen in FIG. 1 includes a base 14 of generally rectangular shape, which base has a pair of ends **14*a* and a number of spaced transverse bores 14*b* formed therein. The base has a centered opening 16** that is of greater diameter than the tubing hanger E for reasons that will later become apparent.

The blow out preventor B has a flat, ring shaped upper surface that has a number of stud bolts 12 projecting upwardly therefrom, with the bolts being so spaced that they may extend upwardly through the bores **14*b* to removably secure the base 14 to the blow out preventer B when the bolts are engaged by nuts 18 as shown in FIG. 2**.

The ends **14*a* of the base 14 have lugs 20 extending outwardly therefrom as shown in FIG. 1, which lugs support bolts 22. Each of the bolts engages a clevis 24 that has one end of an upwardly extending chain 26 secured thereto. The chain 26 is utilized in moving the assembly A to a desired location in the body of water (not shown) in which the oil well of which the well head C is a part is disposed. The ends 14*a* of the base 14 have eye defining members 28 extending outwardly therefrom as shown in FIG. 15, which members may be removably engaged by downwardly extending prongs 30 that are secured to the inner portion of a C shaped platform 32 as illustrated in FIG. 1, which platform has a railing 34** extending upwardly from three sides thereof. The purpose of the platform will later be described.

The assembly A includes two parallel laterally spaced hydraulic cylinders 36 that have lower ends **36*a* which are secured to the base 14 by conventional means. The hydraulic cylinders 36 have upper ends 36*b* through which piston rods 38 extend upwardly, with the cylinders on the upper ends being secured to one another by a cross piece 40. The piston rods 38 on their upper ends are connected by a rigid lifting member 41 as may be seen in FIG. 2 which is secured to the piston rods by bolts 42**.

The lifting member 41 has two longitudinally spaced transverse bores 44 formed therein through which the upper threaded ends 46a of rods 46 extend. The rods 46 are secured to the lifting member 41 by nuts 48 that engage the threaded ends 46a. The rods 46 also include lower threaded ends 46b that extend downwardly through transverse bores 50 formed in an elongate pull plate 52. The lower threaded ends 46b of the rod are engaged by nuts 48 to secure the pull plate 52 to the rods in the position as shown in FIG. 2. The pull plate 52 has an elongate, longitudinally extending opening 54 therein as shown in FIG. 4.

An elongate pulling sub 56 is provided and as shown in FIG. 2 that has a lower threaded end 56a and an enlarged head 56b on the upper end thereof. The head 56b has a tapped recess 56c extending downwardly therein, and at least one pair of diametrically aligned bores 56d. The bores 56d may be removably engaged by an elongate rod or bar (not shown) to rotate the pulling sub 56 for reasons that will later become apparent.

A first carriage 58 of generally elongate shape as may be seen in FIGS. 2 and 4 is provided, which carriage has side walls 58a that on the lower end develop into inwardly extending lugs 58b. The first carriage 58 is slidably movable on an upper extension 62 of the pull plate 52, which extension has a pair of grooves 60 defined therein that are slidably engaged by the lugs 58b as shown in FIG. 4.

The extension 62 on the upper surface has a pair of parallel, laterally spaced first recesses 62a formed therein that are vertically aligned with a second pair of recesses 62b formed on the under surface of the carriage 58. A number of balls 64 movably engage the first and second pair of recesses 62a and 62b as shown in FIG. 4 and movably support the first carriage 58 for longitudinal movement on the pull plate 52. The first carriage 58 has a circular recess 59 that extends downwardly from the top surface thereof and at the junction with an upwardly extending vertical bore 59a defines a body shoulder 59b. The head 56b disposed in recess 59 and is rotatably supported on body shoulder 59b, with the balance of the pulling sub extending downwardly through the bore 59a and opening 54 as may be seen in FIG. 4. The pulling sub 56 is thus rotatably supported relative the first carriage 58 and longitudinally movable relative to the pulling plate 52 due to extending through the elongate opening 54.

The assembly A also includes a safety sub 68 which is in the form of a rod 68a that has a lower threaded end 68b and an enlarged head 68c on the upper end of the rod. The head 68c has at least one transverse bore 68d formed therein, which bore may be engaged by an elongate rod (not shown) to permit rotation of the safety sub 68. The cross piece 40 has an elongate longitudinally extending opening 70 therein that extends through an elevated portion 72 thereof, which portion has a pair of longitudinally extending grooves 72a formed therein as may be seen in FIG. 5.

The elevated portion has an upper surface 72b in which a pair of elongate longitudinally extending recesses 72c are defined. A second carriage 74 is provided that has a vertical bore 74a therein and side members 74b that on their lower ends develop into a pair of inwardly extending lugs 74c. The lugs 74c slidably engage the pair of grooves 72a as may be seen in FIG. 5.

The carriage 74 has a pair of recesses 74d formed in the under portion thereof that are engaged by a number of balls 76, which balls also engage the groove 72c to movably support the second carriage on the cross piece 40 as illustrated in FIG. 5.

The pair of hydraulic cylinders 36 as is conventional with such devices has tubular fittings 78 and 80 in the upper and lower ends thereof to permit pressurized hydraulic fluid to be discharged into and out of the cylinders to move the piston rods 38 and the pull plate 52 that move in conformity therewith.

The cross piece 40 has openings 81 in the ends thereof through which the chain 26 extends, and the chain at substantially the center thereof having a ring 82 secured thereto as shown in FIG. 1. The ring permits the assembly A to be secured to the lower end of a cable (not shown) that extends to a winch (not shown) on a suitable vehicle (not shown) that is used to move the assembly from oil well to oil well as required. Due to the ring 82 being connected to the cable above mentioned, the assembly A is portable and may be moved to a position where it may be secured to a blow out preventer B as shown in FIG. 2.

Figure 3:
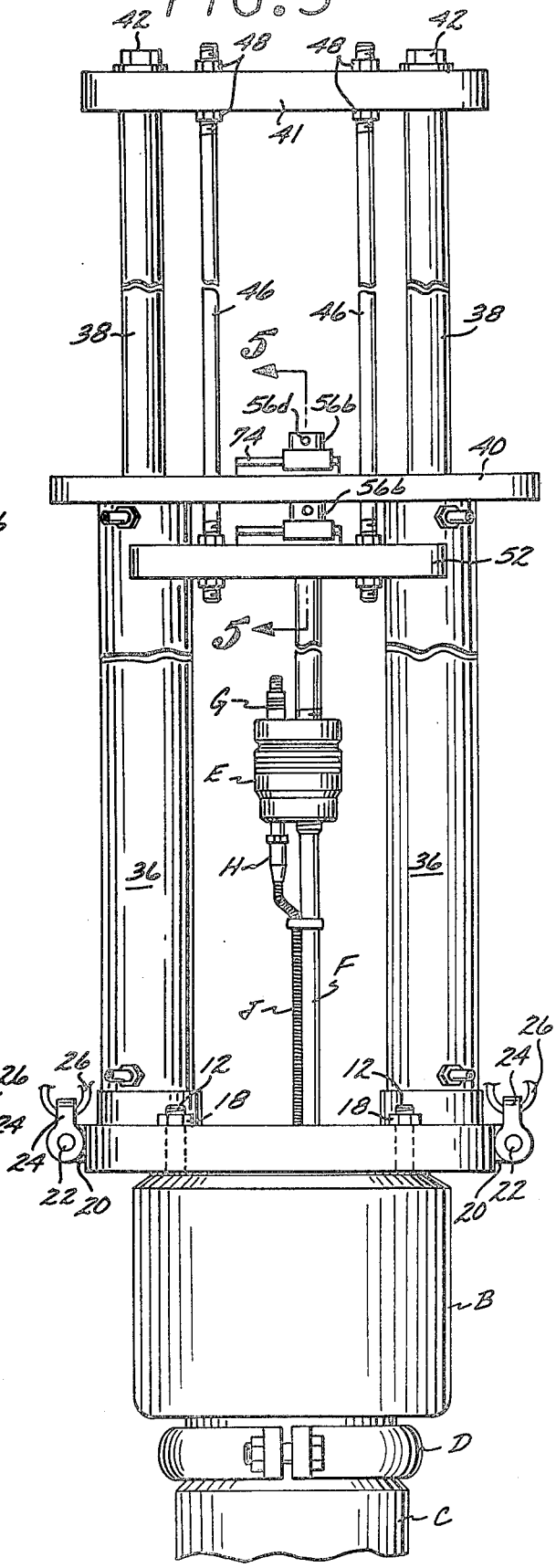
FIG. 3 is the same view as shown in FIG. 2 but with the tubing hanger and tubing string removably secured in a fixed position relative to the hydraulically operated apparatus.

A ladder 84 is provided that has lower portions 84a and upper leg portions 84b, with the lower leg portions being removably insertable in cavity defining members 86 on the upper surface of base 14, and the upper ends in cavity defining members 88 on the cross piece 40. After the assembly A is mounted on the blow out preventer B as shown in FIG. 2, pressurized hydraulic fluid may be discharged into the cylinders 36 to move the piston rods 38 and the pulling plate 52 downwardly. The tubing hanger E as illustrated in FIG. 2 has a passage 88 extending upwardly therethrough that communicates with the tubing string F, and the passage having an upper threaded end 88a. The first carriage 58 is moved on the pulling plate 52 to a position where the first sub 56 may be extended downwardly throughout the blow out preventer B for the threaded end 56a to engage the threaded end 88a in the tubing hanger E by rotating the head 56b of the pulling sub 56. After such engagement hydraulic fluid is discharged into the cylinders 36 to move the piston rods 38 upwardly together with the pulling plate 52. After the tubing hanger E is disposed above the blow out preventer B, the first carriage 58 is moved to the left as viewed in FIG. 2 to position the tubing string F in a centered position in the blow out preventer B, in which position the blow out preventer may be closed to assure that the well at all times is maintained under control. When it is desired to support the tubing hanger E at a fixed position relative to the assembly A, the pulling plate 52 is moved upwardly to the position shown in FIG. 3, with the safety sub 68 then being rotated to position the safety sub in engagement with the threaded recess 56c on the pulling sub as shown in FIG. 5.

The platform 34 if not already secured to the assembly A may be done so, and will occupy the position illustrated in FIG. 1. Likewise the ladder 84 may be secured to the assembly A as shown in FIG. 1 to permit a user (not shown) to replace the connectors H as shown in FIG. 2 when the tubing hanger E has been raised to a substantial distance above the base 14.

After replacement of the connectors H has been completed, the safety sub 68 is rotated to disengage it from the pulling sub 56. The blow out preventor B is now placed in the open position to permit the tubing string J to be moved both longitudingally and laterally therein.

The first carriage 58 is now moved to the right as viewed in FIG. 2 to vertically align the tubing hanger E with the opening 16. The hydraulic cylinders 36 are now utilized to lower the pulling plate 52 to a position where the tubing hanger E moves downwardly through opening 16 to return to a seated position within the well head C.

The nuts 18 are now removed from the stud bolts 12, and by use of the chain 26 the assembly A is lifted and separated from the blow out preventer B. The platform 32 and ladder 84 are preferably separated from the assembly A prior to the above described lifting operation. The platform 32 serves as a support for a user (not shown) when replacements of connectors H are made with the tubing hanger E in the position shown in FIG. 2. When the tubing hanger E is at a higher elevation, the ladder 84 permits the user (not shown) to position himself at a convenient location relative thereto.

The tubing string F after the tubing hanger E is returned to its original position in the well head C still has the plug (not shown) therein. The clamp D is now removed, and the blow out preventer separated from the well head C. The array of valves (not shown) is now mounted on the well head C by use of the clamp D. The plug (not shown) is now removed from the tubing string J, and the well may be returned to production.

Figure 6:
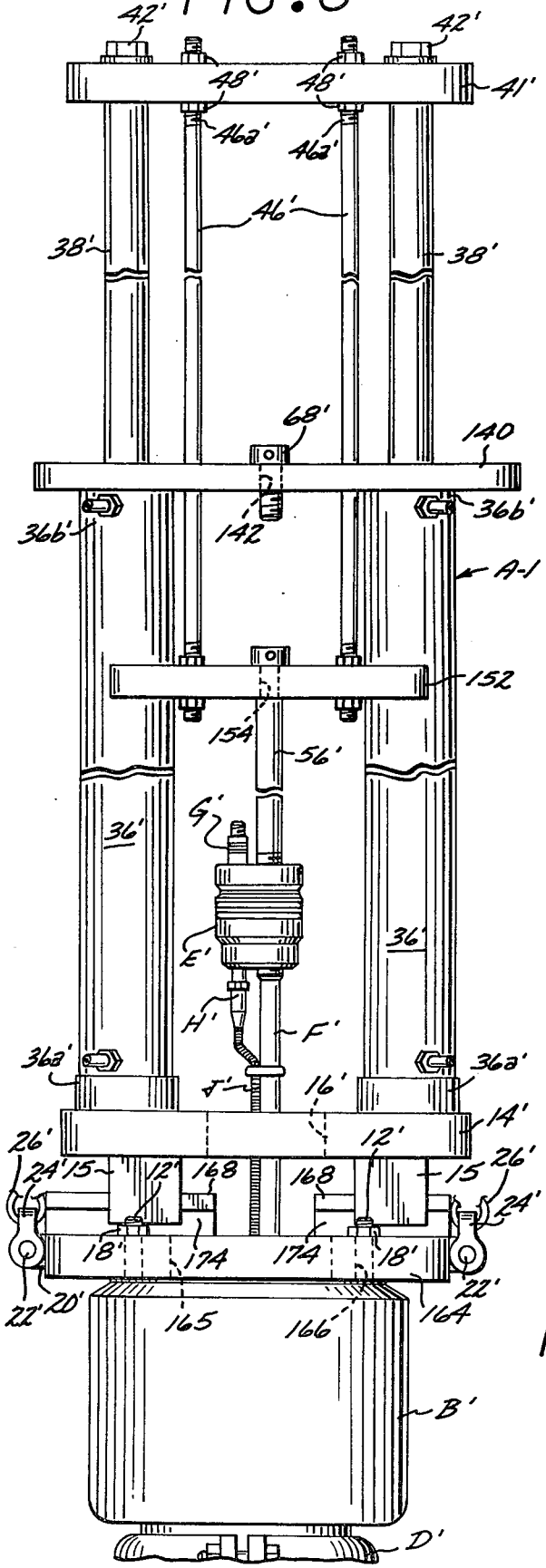
FIG. 6 is a side elevational view of a second form of the invention in a tubing hanger and tubing string lifting position.
Figure 7:
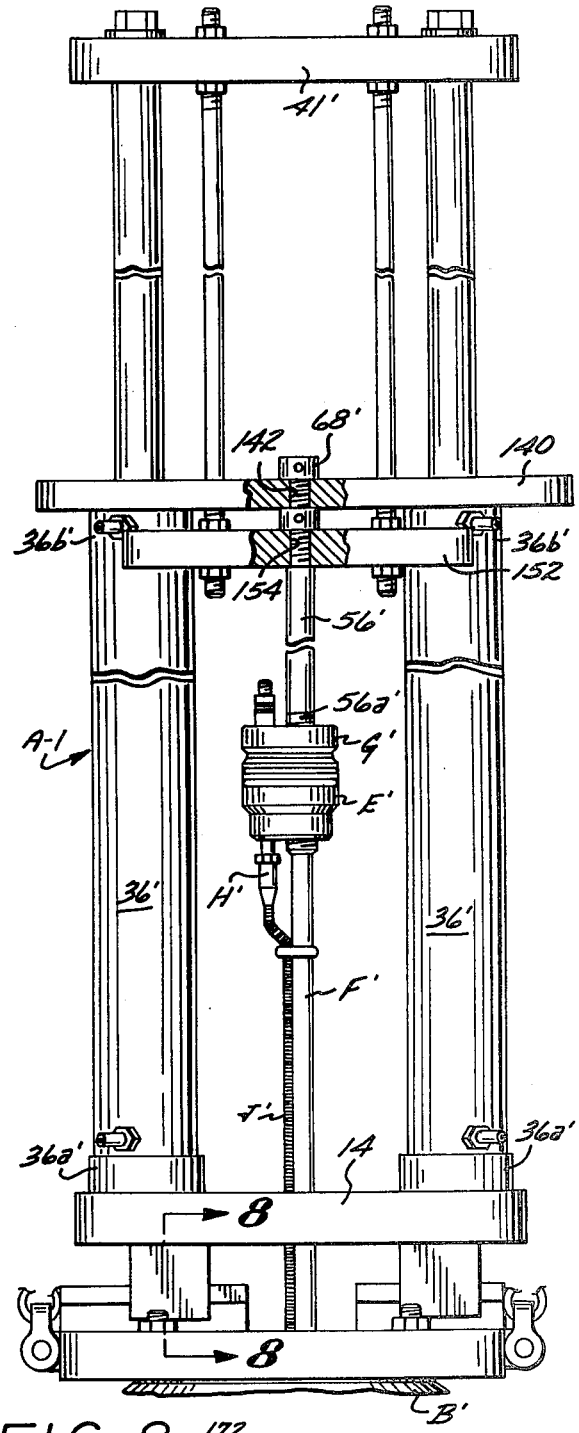
FIG. 7 is the same side elevational view as shown in FIG. 6 but with the tubing hanger removably secured thereto.

A second form of the hydraulically operated tubing hanger lifting assembly A-1 is shown in FIGS. 5 and 6. The second form A-1 differs from the first form A in that lateral shifting of the tubing string F relative to the blow out preventer B is achieved by moving the hydraulic cylinders 36 transversely when the blow out preventer is in an open position, and thus permit the tubing string to be centered in the blow out preventer and the latter closed to maintain control of the well. The second form A-1 of the assembly when used provides the same operational advantages as the first form A.

In FIGS. 5 and 6 elements of the second form A-1 of the assembly elements thereof that are common to the first form are identified by the numerals and letters previously used but with primes being added thereto. In the second form A-1 of the assembly a cross piece 140 is provided that has a centered transverse bore 142 in which the safety sub 68' is rotatably supported. The second form A-1 includes a pulling plate 152 in which a centered transverse bore 154 is formed and through which the pulling sub 56' extends downwardly.

Figure 8:
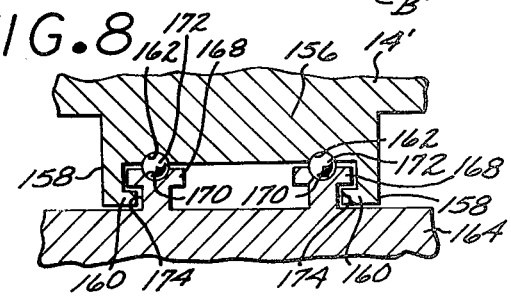
FIG. 8 is a fragmentary vertical cross sectional view of the second form of the invention taken on the line 8—8 of FIG. 7.

Base 14 has two downward extensions 156 that are coaxially aligned and situated on opposite sides of the opening 16. Each extension 156 includes a pair of spaced parallel side members 158 that have inwardly extending lugs on the lower ends thereof as shown in FIG. 8. The extensions 156 each have a pair of parallel, laterally spaced first recesses 162 defined in the lower surface thereof.

A heavy support plate 164 is provided that overlies the top of the blow out preventer B'. Plate 164 has a number of spaced transverse bores 166 therein as shown in FIG. 6 through which stud bolts 12' extend upwardly, with the bolts being engaged by nuts 18' to secure the plate to the blow out preventer. The support plate 164 has a centered opening 165 therein through which the tubing hanger E' may be upwardly and downwardly. Two sets of rails 168 are situated on opposite sides of the opening 165, with the rails having second recesses 170 on the upper surfaces thereof in which balls 172 are disposed that also engage the first recesses 162. The rails 168 have grooves 174 therein that are slidably engaged by the lugs 160. The base 14' due to the structure previously described is transversely movable relative to the support plate 164.

The second form A-1 of the assembly is used in the same general manner as the first form A, but with the lateral shifting of the tubing string F' to achieve a centered position being accomplished by laterally moving the base 14' relative to the blow out preventer B' is necessary to permit the latter to be placed in a closed position to maintain control of the well.

In FIG. 6 it will be noted that in the second form A-1 of the tubing hanger lifting assembly that the pair of clevis 24' and assembly lifting chain 26' are secured to the support plate 164 rather then the base 14 as in the first form A of the assembly.

A third form A-2 of the assembly is shown in FIGS. 9 to 14 inclusive. In the third form A-2 elements common to the first form A are identified by the same numerals and letters previously used but with double primes being added thereto. The third form A-2 of the assembly permits the tubing string F" and tubing hanger E" to be advanced upwardly from the well of which the well head B" forms a part to the extent that connectors H" on the electric motor (not shown) that drive the downhole pump (not shown) may be replaced.

Figure 9:
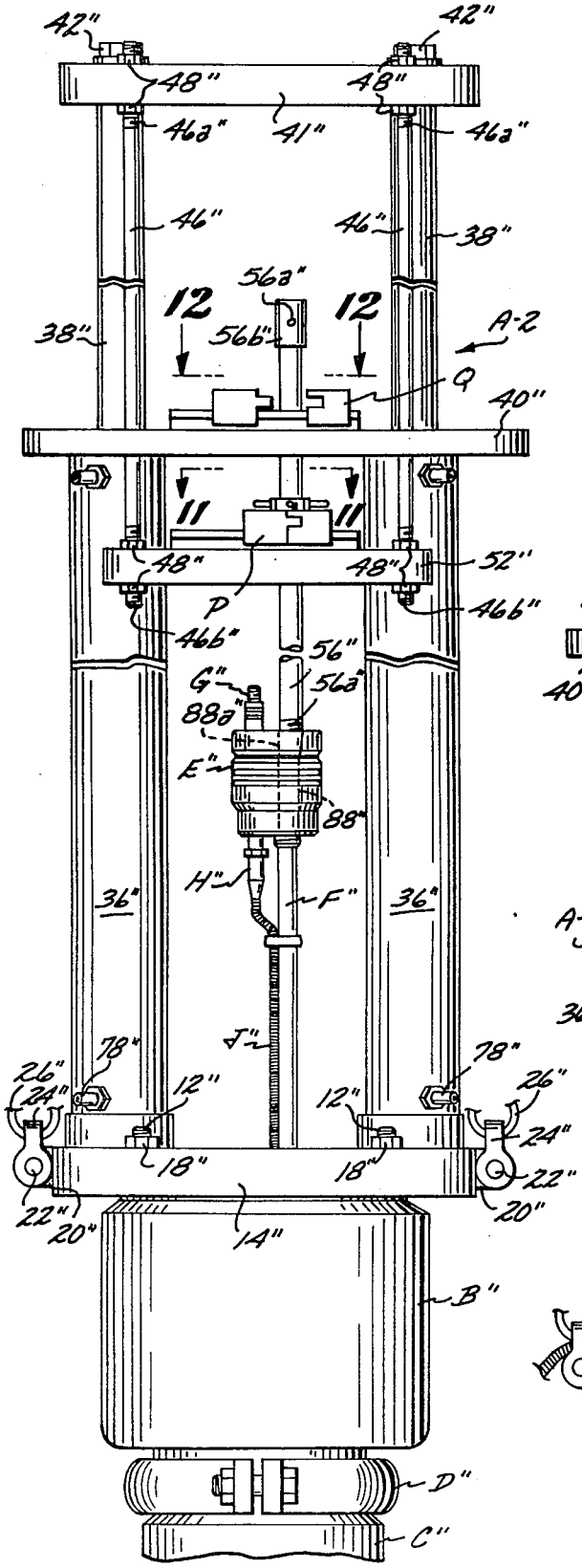
FIG. 9 is a side elevational view of a third form of the invention raising a tubing hanger and tubing string.
Figure 10:
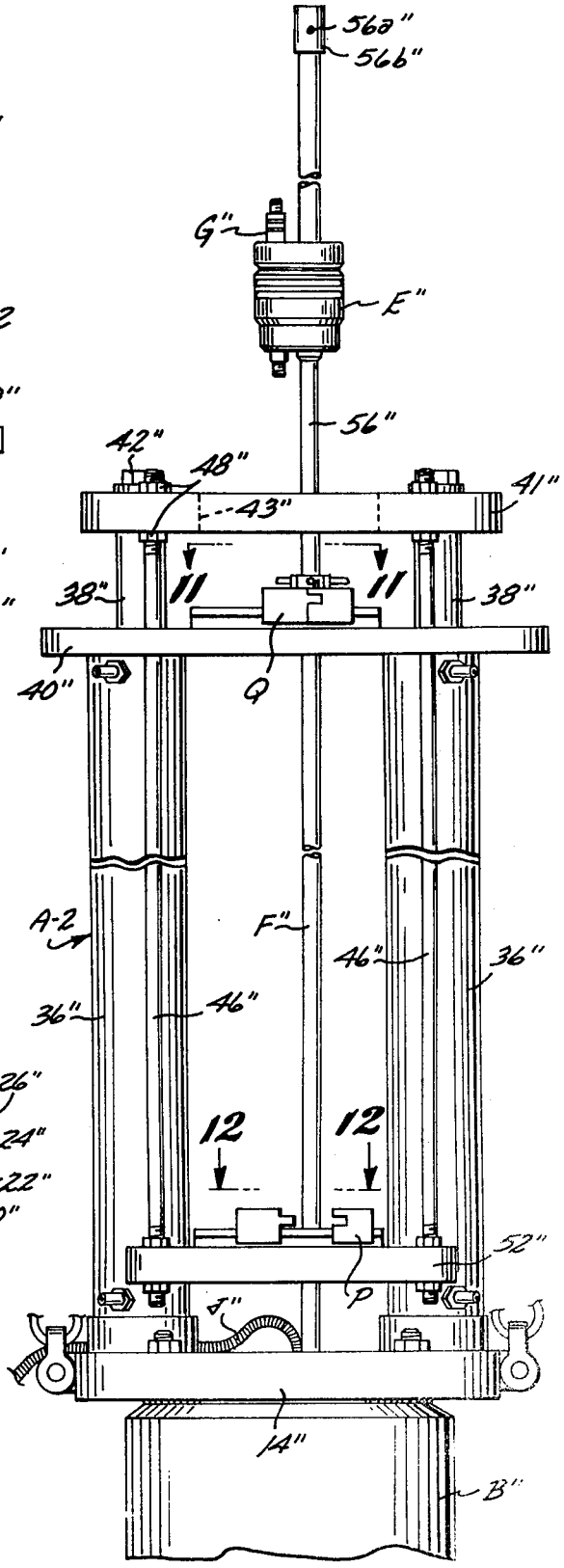
FIG. 10 is the same view as shown in FIG. 9 but with the tubing string removably held at a fixed position relative thereto by slips that form a part of the invention.

In FIGS. 9 and 10 it will be seen that first and second slip supporting assemblies P and Q are mounted on the pulling plate 52" and the cross piece 40". The pulling plate 52" has a generally centered transverse opening 200 therein that is of substantially greater diameter than the tubing hanger E". The first slip supporting assembly P includes a pair of rails 202 are longitudinally disposed on the upper surface of the pulling plate 52" and situated on opposite sides of the opening 200 as may be seen in FIG. 13. Each of the rails 202 has a first longitudinally extending groove 204 defined in the top thereof. Each rail 202 has a longitudinally extending recess 206 formed in the outer side thereof as shown in FIG. 13. First and second slip supporting rigid members 208, 210 extend transversely between the pair of rails 202, with each of the slip supporting members having a side wall 212 that extends downwardly therefrom, and a lug 214 extending inwardly from the lower end of the latter to slidably engage one of the recesses 206 as shown in FIG. 13. The first and second slip supporting members 208 and 210 have second grooves 216 formed in the lower surfaces thereof that engage balls 218 that are mounted in the first grooves 204 with the first and second slip supporting members 208 and 210 accordingly being longitudinally movable on the rails 202.

The first and second slip supporting members 208 and 210 have tongue and groove structures **208*a* and 210*a* as shown in FIG. 14 which engage one another when the slip supporting members are in abutting contact. The first and second slip supporting members 208 and 210 when in abutting contact as shown in FIG. 14 have vertically aligned bores 220 therein through which pins 222** may be extended downwardly to removably lock the slip supporting members together.

In FIG. 12 it will be seen that the slip supporting members 208 and 210 on their adjacent edges have centered semi-circular, downwardly extending tapered recesses **208*b* and 210*b* therein, which when the slip supporting members are in the locked position as shown in FIG. 14 cooperate to define a frusto conical opening in which an assembly of slips 224 may be disposed. Each of the slips 224 have an outwardly extending handle 224*a* to facilitate the removal and insertion of the slips in the opening defined by the recesses 208*b* and 210*b***.

The cross piece 40″ has a centered opening 300 therein of greater diameter than the tubing hanger E″. The second slip supporting assembly Q is mounted on the upper surface of cross piece 40″ is of the same structure as the first slip supporting assembly P. The same numerals are accordingly used to identify the elements of the second assembly Q as used in the first assembly P. Accordingly a detailed description of the second slip supporting assembly Q is not required.

The use and operation of the third form A-2 of the tubing hanger lifting assembly is as follows. The array of valves (not shown) normally on the well head C″ is removed and replaced by the blow out preventer B″ as shown in FIGS. 9 and 10, with the third form A-2 of the assembly removably secured to the blow out preventer by use of the bolts 12″ and nuts 18″. The tubing string F″ has a plug (not shown) removably inserted therein.

The pulling sub 56″ is now moved downwardly between the slip supporting members 208 and 210 of the first assembly P when they are moved to the spaced relationship to one another as shown in FIG. 12. The lower threaded end 56*a*″ of the pulling sub 56″ is caused to engage the threads 88*a*″ of the tubing hanger E″. The pulling plate 52″ is now moved downwardly relative to the pulling sub 56″, and the slip supporting members 208 and 210 moved to the closed position as shown in FIG. 11, and slips 224 disposed therein to grip the pulling sub 56″.

The first slip assembly P is now moved to the left as viewed in FIG. 9 to center the tubing string F″ within the blow out preventer B″ to permit the latter to be closed if necessary to maintain control of the well on which the well head C″ forms a part. Hydraulic fluid is now discharged into the cylinders 36″ through the tubular members 78″ to move the pulling plate 52′ and pulling sub 56″ upwardly to the extent that the head 56*b*″ of the pulling sub is above the cross piece 40″ as shown in FIG. 9. The cross piece 40″ has an opening 43″ therein through which the pulling sub 56″ may move upwardly. The second slip assembly Q is now moved to a position to grip the pulling sub 56″ below the head 56*b*″thereof.

The slips 224 in the first slip assembly P are now removed, and the slip supporting members 208 and 210 are moved to the open position as shown in FIG. 12 to permit the pulling plate 52′ to be lowered downwardly below the tubing hanger E″. The connectors H″ are removed from the tubing hanger E″, and the cable J″ separated from the tubing string F″. The first slip assembly P′ is now moved to a closed position a substantial distance below the tubing hanger E″ and the slips 224 are inserted therein to grip the tubing string F″. The second slip assembly Q is now placed in the open position, and by discharging hydraulic fluid into the cylinders 36″ through the tubular members 78″ the pulling plate is moved upwardly to advance the tubing hanger E″ to a position above third form A-2 as viewed in FIG. 12. By sequentially moving the pulling plate 52″ upwardly and downwardly relative to the cross piece 40″, the tubing string F″ may be removed in stages from the well of which the casing head C″ forms a part. On the up stroke the first slip assembly P is in gripping engagement with the tubing string 56″ and the second slip assembly Q is out of engagement therewith.

Prior to a down stroke the second slip assembly Q is caused to grip the tubing string F″ to temporarily support the latter at a fixed elevation while the pulling sub and the first slip assembly P in a non tubing engaging position are moved downwardly relative to the tubing string. After the down stroke has been completed the above described upstroke is repeated to again advance the tubing string upwardly. As stands of tubing F″ are elevated or lowered they move longitudinally through the opening 43″ formed in the lifting member 41″.

The tubing string F″ may be advanced upwardly in stages as above described to the extent that the connector H″ (not shown) on the electric motor (not shown) that powers the downhole pump (not shown) may be replaced. When the necessary connector replacements have been completed, the above described operation is reversed to return the well to an oil producing condition.

The blow out preventer B and the well head D are of a structure currently in use on oil wells and are accordingly not described in detail. When either the assemblies A, A-1, or A-2 are desired to be used on a well for which the diameter of opening 16 is not appropriate, an adapter plate may be provided (not shown) that is secured to the base 14.

The use and operation of the invention has been described previously in detail and need not be repeated.

What is claimed is:

1. In combination with a producing oil well that has a well head that removably supports an array of valves that are in communication with a vertical off centered passage in a well hanger from which a tubing string extends downwardly in an off centered position in said well to a downhole pump that is driven by an electric motor that is supplied electric power through a cable that extends upwardly in said well to a connector that removably engages an off centered vertical electrical conductor supported by said tubing hanger and said conductor having an upper end that by a connector is connected to a source of electric power, said passage in said tubing hanger having an upper threaded end, a portable apparatus for elevating said tubing hanger to a position above said well head where said connectors may be replaced by a user after said tubing string has had a plug removably positioned therein, said array of valves has been removed from said well head and replaced by a power operated blow out preventer that has an upper surface, said blow out preventer when in an open position defining a vertically extending space of sufficient transverse cross section as to permit said tubing hanger and a portion of said tubing string situated therebelow to be moved upwardly and downwardly therethrough and said blow out preventer when in a closed position and said tubing hanger situated thereabove sealingly gripping said tubing string when the latter is centered therein to maintain control of said well, said portable apparatus comprising:

a. a power operated assembly that includes a horizontal base having a transverse opening therein of greater diameter than said tubing hanger; a pair of parallel hydraulic cylinders that extend upwardly from said base on opposite sides of said opening and have upper ends; a pair of piston rods that extend upwardly from said pair of cylinders and have upper ends, a horizontal cross piece that extends between said upper ends of said pair of cylinders; a lifting member that extends between said upper ends of said piston rods; a plurality of pull rods having lower ends, said pull rods depending from said lifting member and slidably movable in transverse openings in said cross piece; a horizontal pulling plate secured to said lower ends of said pull rods; first means for discharging pressurized hydraulic fluid into and out of said cylinder to raise and lower said pulling plate;

b. threaded pulling sub means that removably engage said threaded end of said passage in said tubing hanger and are rotatably supported from said pulling plate, said pulling sub means and pulling plate moving said tubing hanger and a portion of said tubing string upwardly through said opening in said base when hydraulic fluid is discharged into said cylinders and said blow out preventer is in an open position with said tubing string in an off centered position therein;

c. second means on said assembly for moving said well head and tubing string laterally relative to well bore to a position when said tubing string is centered in said blow out preventer to permit the latter to be actuated to assume a closed position to maintain control of said oil well;

d. third means that occupy a fixed elevation on said assembly for preventing inadvertent downward movement of said tubing hanger and tubing string during the time said connectors are being replaced; and e. fourth means for removably maintaining said base at a fixed vertical position relative to said blow out preventer.

2. A portable apparatus as defined in claim 1 which in addition includes:

e. a lifting chain secured to opposite ends of said base and extending through a pair of transverse openings in said cross piece adjacent the ends thereof.

3. A portable apparatus as defined in claim 1 which in addition includes:

f. a platform capable of being disposed adjacent said base; and g. fourth means for removably securing said platform to said base, said platform serving as a support for a user during the time the latter is replacing said connectors.

4. A portable apparatus as defined in claim 1 in which said pulling plate has an elongate opening therein through which said pulling sub extends, and said second means is a first carriage longitudinally movable on said pulling sub that removably engages said pulling sub means to permit said tubing hanger and tubing string to be moved longitudinally relative to said pulling plate to a position where said tubing string is centered in said blow out preventer.

5. A portable apparatus as defined in claim 1 in which said third means is a second carriage longitudinally movable on said cross piece; and f. fifth means mounted on said second carriage for removably engaging said pulling sub when the latter is supported by said first carriage.

6. A portable apparatus as defined in claim 1 in which said fourth means includes:

f. a plurality of stud bolts that extend upwardly from said upper surface of said blow out preventer;

g. a support plate that has a plurality of spaced transverse bores therein through which said stud bolts extend to removably maintain in a fixed position on said upper surface of said blow out preventer, said support plate having a transverse opening therein of greater diameter than said tubing hanger;

h. a plurality of nuts that engage said stud bolts;

i. a pair of extensions that depend from said base on opposite sides of said opening therein;

j. a pair of rails that extend upwardly from said support plate on opposite sides of said opening therein and are in engagement with said pair of extensions, said support plate, pair of extensions, and pair of rails cooperating to maintain said base at a fixed vertical position relative to said blow out preventer, and said second means being bearing means operatively associated with said pairs of extensions and rails to permit said assembly to be shifted laterally when supporting said tubing hanger and tubing string to dispose said tubing string in a centered position in said blow out preventer when said tubing hanger is disposed above said base.

7. A portable apparatus as defined in claim 6 in which said bearing means are a plurality of balls disposed in elongate grooves defined in adjacent surfaces of said pair of rails and pair of extensions.

8. A portable apparatus as defined in claim 1 in which said pulling plate has a transverse opening therein of greater diameter than that of said tubing hanger and substantially vertically aligned with said opening in said base and said second means including:

f. a first set of slips that have arcuate interior surfaces that may frictionally engage the exterior surfaces of both said pulling sub and said tubing string; and g. fifth longitudinally movable means on said pulling plate for removably supporting said first set of slips on the latter to frictionally engage said pulling sub to permit said tubing hanger to be raised above said base with said pulling sub, tubing hanger and tubing string when supported by said fifth means and first set of slips capable of being moved longitudinally to a position where said tubing string is centered in said blow out preventer.

9. A portable apparatus as defined in claim 8 in which said cross piece has a transverse opening therein of greater diameter than that of said tubing string and substantially vertically aligned with said opening in said pulling plate and said third means including:

h. a second set of slips that have arcuate interior surfaces that may frictionally engage the exterior surfaces of both said pulling sub and tubing string; and i. sixth longitudinally movable means on said cross piece for removably supporting said second set of slips on the latter to frictionally engage both said pulling sub and tubing string to prevent inadvertent downward movement thereof as said tubing string is sequentially raised in a series of stages from said bore hole.

* * * * *